US006758126B1

(12) United States Patent
Houtsma

(10) Patent No.: US 6,758,126 B1
(45) Date of Patent: Jul. 6, 2004

(54) APPARATUS FOR INITIALLY SLOWLY A BACKWARDS MOVEMENT OF A BOLT GROUP

(75) Inventor: Gary J. Houtsma, Denville, NJ (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 0 days.

(21) Appl. No.: 10/250,085

(22) Filed: Jun. 3, 2003

Related U.S. Application Data

(60) Provisional application No. 60/320,040, filed on Mar. 24, 2003.

(51) Int. Cl.[7] ..... F41C 23/00

(52) U.S. Cl. ..... 89/198; 89/199; 42/1.06; 42/74

(58) Field of Search ..... 42/1.06, 74; 89/198, 89/199

(56) References Cited

U.S. PATENT DOCUMENTS 3,039,222 A * 6/1962 Hoge ..... 42/74
3,300,889 A * 1/1967 Baker ..... 42/74
3,568,565 A * 3/1971 Sweiskowski ..... 89/198
3,650,177 A * 3/1972 Hupp et al. ..... 89/130
3,707,797 A * 1/1973 Ruth ..... 42/74
3,714,726 A * 2/1973 Braun ..... 42/74
3,977,296 A * 8/1976 Silsby et al. ..... 89/198
4,126,080 A * 11/1978 Reynolds ..... 89/199
4,307,653 A * 12/1981 Goes et al. ..... 89/198
4,335,644 A * 6/1982 Goes et al. ..... 89/198
4,388,855 A * 6/1983 Sokolovsky ..... 89/198
4,439,943 A * 4/1984 Brakhage ..... 42/74
4,558,628 A * 12/1985 Bosshard ..... 89/198
4,769,937 A * 9/1988 Gregory et al. ..... 42/74
5,031,348 A * 7/1991 Carey ..... 42/74
5,909,002 A * 6/1999 Atchisson ..... 89/130
6,536,324 B1 * 3/2003 Boissiere et al. ..... 89/14.3
6,668,478 B2 * 12/2003 Bergstrom ..... 42/1.06
2002/0178901 A1 * 12/2002 Bergstrom ..... 89/198

* cited by examiner

*Primary Examiner*—Michael J. Carone
*Assistant Examiner*—Troy Chambers
(74) *Attorney, Agent, or Firm*—Michael C. Sachs; John F. Moran

(57) ABSTRACT

An apparatus 10 is provided for initially slowing a backwards extraction movement of a bolt group 12 of a weapon which moves backward automatically after firing and against a force of a return drive spring 14. The apparatus includes first and second longitudinal members 16, 30 having respective distal ends and proximal ends. A mounting mechanism is provided for mounting the first and second members for longitudinal movement of the first member relative to the second member and adjacent the drive spring, with the drive spring urging the first and second members apart and against the bolt group. A retarding mechanism 36 is provided for retarding an initial backwards movement of the first proximal end relative to the second distal end, and for allowing a relatively free further backwards movement of the first proximal end relative to the second distal end as the bolt group moves backwards after firing.

12 Claims, 2 Drawing Sheets

APPARATUS FOR INITIALLY SLOWLY A BACKWARDS MOVEMENT OF A BOLT GROUP

CROSS REFERENCE TO RELATED APPLICATIONS

This Application claims priority of U. S. Provisional Patent Application No. 60/320040, filed Mar. 24, 2003.

FEDERAL RESEARCH STATEMENT

The inventions described herein may be manufactured, used and licensed by or for the U.S. Government for U.S. Government purposes.

BACKGROUND OF INVENTION

In some firearms with a rotating bolt that locks the bolt to the barrel, for example the M16 family of weapons, there are problems with extracting fired cases from the firing chamber. This problem arises when the bolt group rotates to unlock and start moving rearwards, as there is a centrifugal spin force created which can cause the extractor of the bolt group to move or spin off of the empty cartridge case rim and hence cause a failure to extract the empty cartridge casing. The high recoil velocity of the bolt also overcomes the spring force of the extractor which causes the extractor to lift off the case rim.

For the M16 weapon family, various solutions have been proposed to solve the extraction failure problem. These solutions generally involved decreasing of the power drive of the operating group. For example, larger gas tubes have been proposed to slow the extraction time and hence to reduce the centrifugal force. However, this proposed solution was disadvantageous since the larger gas tubes decreased the rate of fire and had function problems in cold weather.

Another proposed solution was the use of different drive springs. While this resulted in a slower extraction and hence less centrifugal force, this proposed solution was disadvantageous since it created short recoils. The bolt group does not move rearward enough to strip the next live round to be fired. The heavy drive spring also creates bolt bounce which prevents the firing pin from contacting the primer of the cartridge.

The use of heavy buffer weights as a solution to the extraction problem was also proposed. However, such buffer weights created short recoils which prevents the operating group from stripping the next round out of the magazine.

Still another proposed solution was to use different extractor springs.

However, smaller extractor springs resulted in failures of the extractor to snap on the cartridge rim.

Thus, a solution which provided a reliable extractor which did not adversely effect the firing rate was desired for rotating bolt groups.

SUMMARY OF INVENTION

In accordance with the present invention, an apparatus is provided for initially slowing a backwards extraction movement of a bolt group of a weapon firing a projectile. This bolt group moves backward automatically after firing of the projectile, against a force of a return drive spring. The apparatus includes a first longitudinal member having a first distal end and a first proximal end and a second longitudinal member having a second distal end adjacent the first proximal end and a second proximal end. A mounting means is provided for mounting the first and second members for longitudinal movement of the first member relative to the second member and adjacent the drive spring, with the drive spring urging the first and second members apart and opposing the extraction movement of the bolt group. A retarding means is then provided for retarding an initial backwards movement of the first proximal end relative to the second distal end, and also for allowing a relatively free further backwards movement of the first proximal end relative to the second distal end as the bolt group moves backwards after firing.

In a preferred embodiment, the mounting means includes a third longitudinal member having a third distal end and a third proximal end. The mounting means mounts the second and third members for longitudinal movement of the second member relative to the third member and adjacent the drive spring, with the drive spring urging the second and third members apart and against the bolt group. In addition, a latch means is provided for releasably latching the second proximal end to the third distal end. This latch means includes a release member which is contacted when the first proximal end approaches the second proximal end to release the latching of the second proximal end to the third distal end.

In the preferred embodiment, the retarding means includes a hydraulic chamber inside of the second member which is filled with a hydraulic fluid. A longitudinally short, inwardly reduced wall section of the chamber is then provided adjacent the second distal end, and a piston head at the first proximal end is initially disposed at the reduced wall section. The piston head is sized to pass along the reduced wall section with a movement which is retarded by the passage of the hydraulic fluid thereabout. Then, after the piston head passes the reduced wall section, the piston head easily passes along a remainder of the hydraulic chamber as the hydraulic fluid passes easily about the piston head and a remainder wall section of the chamber.

Also in the preferred embodiment, the first longitudinal member is a piston member which is disposed inside of the drive spring. This piston member includes an elongate piston rod with the piston head provided at the first proximal end, and an enlarged piston stop provided at the first distal end against which a first end of the drive spring is engaged. In addition, the second longitudinal member is a cylinder member disposed inside of the drive spring which has the chamber disposed therein. Further, the third longitudinal member is a buffer guide disposed inside of the drive spring which telescopically receives the second proximal end of the cylinder member. The buffer guide includes an enlarged buffer stop at the third proximal end against which a second end of the drive spring is engaged.

Further in the preferred embodiment, the release member is contacted by the piston head to release the second proximal end from the third distal end so that the second proximal end is then received in the buffer guide. In addition, the release member is spring biased towards the piston head and includes a camming surface. The latch means then includes a pair of latch members having oppositely directed shoulders which engage the third distal end of the buffer guide. The latch members also include inwardly directed latch distal cams which slide along the camming surface of the release member and inwardly directed latch proximal cams. The latch members are each pivotally mounted to the second proximal end. The release member includes a release proximal end which contacts the inwardly directed latch proximal cams as the release member is moved proximally, such that the latch members are pivoted to positively move respective shoulders from engagement with the third distal end.

It is an advantage of the present invention that a rotating bolt group with a reliable extraction operation is provided.

It is also an advantage of the present invention that, together with reliable extraction of the empty cartridge case effected with an initial retarding of the extraction movement, there is no appreciable decrease in the firing rate of the weapon attributable to the retarding.

It is a further advantage that the apparatus of the present invention fits within the confines of the prior art drive spring or drive spring compartment.

Other features and advantages of the present invention are stated in or apparent from detailed descriptions of presently preferred embodiments of the invention found hereinbelow.

BRIEF DESCRIPTION OF DRAWINGS

The single figure is a schematic cross sectional side view of an apparatus for initially slowing the backwards extraction movement of a bolt group of an M4 carbine in accordance with the present invention.

DETAILED DESCRIPTION

Figure 1:
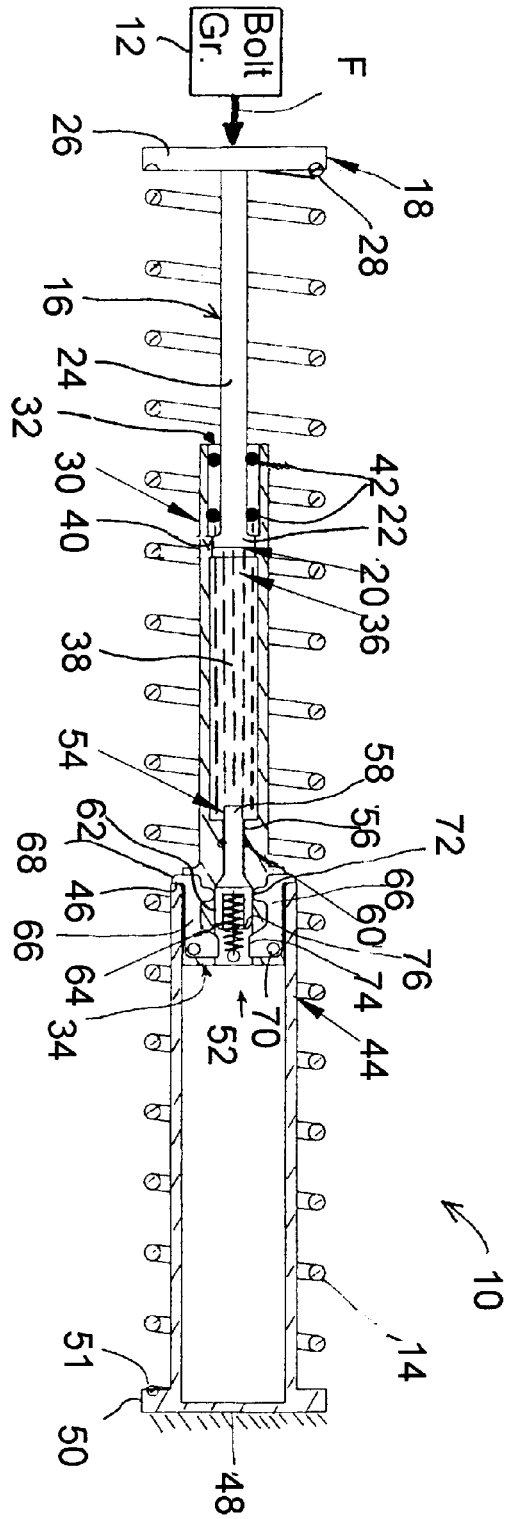

With reference now to the drawing in which like numerals represent like elements, an apparatus 10 is schematically depicted in the single figure. In general, apparatus 10 acts as a hydraulic buffer to initially slow a backwards extraction movement (shown by the force arrow F) of a bolt group 12 (schematically depicted for convenience) of a weapon firing a projectile against a force of a return drive spring 14. It will be appreciated that the drive spring of a carbine such as the M4 is typically housed in a compartment of the carbine to restrict the movement of the drive spring to an essentially rectilinear movement and to protect the spring and associated elements, and that drive spring 14 of the present invention is similarly restricted even though the compartment or any other part of the weapon is not depicted. It will also be appreciated that apparatus 10 can function with bolt group 12 provided at either longitudinal end, but for convenience apparatus 10 is depicted with a proximal end positioned against a base and a distal end positioned against bolt group 12.

Apparatus 10 includes a first longitudinal member or piston member 16 having a piston distal end 18 and a piston proximal end 20. Piston member 16 is disposed coaxially inside of drive spring 14 and includes: a piston head 22 at piston proximal end 20, an elongate piston rod 24 extending proximally from piston head 22, and an enlarged piston stop 26 provided at piston distal end 18. As shown, piston stop 26 is engaged by a spring distal end 28 of drive spring 14.

Apparatus 10 also includes a second longitudinal member or cylinder member 30 having a cylinder distal end 32 and a cylinder proximal end 34. Cylinder member 30 is also coaxially disposed inside of drive spring 14 and is configured to allow piston member 16 to move longitudinally relative thereto. It will thus be appreciated that during the backwards movement of bolt group 12, drive spring 14 will increasingly oppose the backwards movement of piston member 16 (and hence urge piston member 16 away from cylinder member 30) as drive spring 12 presses against piston stop 26 and towards bolt group 12, so that the backwards movement will cease after a sufficient backwards movement and ejection of the empty casing and drive spring 14 will then return bolt group 12 together with a picked up loaded casing back to the firing position in the barrel. Cylinder member 30 includes therein a hydraulic chamber 36 which is filled with a hydraulic fluid 38. Chamber 36 is provided, adjacent cylinder distal end 32, with a longitudinally short (about Â¼inch) inwardly reduced wall section 40, with the remainder of the inner wall section of chamber 36 being substantially larger than reduced wall section 40. As shown, disposed inside of cylinder member 30 adjacent to cylinder distal end 32 are sealing O-rings 42 which surround piston rod 24. O-rings 42 prevent any hydraulic fluid from leaking out of cylinder member 30 during the operation of bolt group 12 and apparatus 10 as described below.

It will be appreciated that piston head 22 is initially disposed (when bolt group 12 locks a cartridge in the firing chamber) in reduced wall section 40. After firing and as bolt group 12 begins the backwards extraction movement, reduced wall section 40 is radially sized (or reduced wall section 40 or piston head 22 otherwise configured, as by one or more passages therethrough) to allow piston head 22 to pass therealong with a movement which is retarded by a passage of hydraulic fluid 38 past piston head 22 and hence out of chamber 36. However, once piston head 22 passes by reduced wall section 40 (i.e., after the first Â¼inch of movement of bolt group 12), there is plenty of clearance between piston head 22 and the remainder of the wall section of chamber 36 so that there is no longer any retarding of the movement of piston head 22 and hence of bolt group 12 caused by passage of hydraulic fluid past piston head 22. Thus, it will be noted that the disposing of piston head 22 at reduced wall section 40 with a clearance or configuration which prevents hydraulic fluid 38 from flowing freely therebetween acts as a retarding means for the initial movement of piston member 16 and hence of bolt group 12. It will also be noted that the use of O-rings together with the guided movement of drive spring 14 serve as a mounting means for mounting piston member 16 for coaxial movement relative to cylinder member 30.

Apparatus 10 further includes a third longitudinal member or buffer guide 44 having a buffer distal end 46 and a buffer proximal end 48. Buffer guide 44 is similarly disposed coaxially inside of drive spring 14, and buffer proximal end 48 is positioned against some base or the like of the compartment in which drive spring 14 is disposed in the weapon. As shown, cylinder proximal end 34 telescopically fits inside of buffer guide 44 with a free sliding fit, so buffer guide 44 also serves to mount cylinder member 30 for sliding movement in buffer guide 44. Buffer guide 44 includes an enlarged buffer stop 50 at buffer proximal end 48 against which a second end 51 of drive spring 14 is disposed so that drive spring 14 always urges cylinder member 30 and piston member 16 away therefrom and hence away from the base.

It will be appreciated that a latch means 52 is provided for releasably latching cylinder proximal end 34 to buffer distal end 46, so that piston head 22 can function as an initial retarding mechanism for bolt group 12. Latch means 52 includes a release member 54 which is actuated by contact with piston head 22 to cause latch means 52 to release cylinder proximal end 34 from buffer distal end 46. As shown, release member 54 is disposed in a central bore 56 provided in cylinder proximal end 34 and has a stem 58 which is surrounded by a sealing O-ring 60 to prevent any hydraulic fluid 38 in chamber 36 from leaking thereby. Release member 54 also includes an enlarged locking section of a camming surface 62 which enlarged locking section serves to lock cylinder proximal end 34 to buffer distal end 46. A spring 64 partially provided in a bore located in the proximal end of release member 54 and attached to cylinder proximal end 34 urges release member 54 towards cylinder distal end 32 and hence into the position where latch means 52 latches cylinder proximal end 34 to buffer distal end 46.

Latch means 52 also includes a pair of latch members 66 having oppositely directed shoulders 68 which longitudinally engage buffer distal end 46. Each latch member 66 is pivotally mounted to cylinder proximal end 34 at respective pivots 70, and includes inwardly directed latch distal cams 72 which are commonly directed radially to slide along release member 54 from the enlarged locking section of camming surface 62 to an adjacent reduced section where shoulders 68 are no longer locked or held securely in place (in the position depicted). It will also be appreciated that inwardly directed latch proximal cams 74 of each latch member 66 are disposed to be contacted by a release proximal end 76 of release member 54 as release member 54 is driven backwards to cause latch members 66 to pivot shoulders 68 out of engagement with buffer distal end 46. Thus, when release member 54 is in the position shown, latch members 66 prevent cylinder member 30 from being telescopically received in buffer guide 44. However, when piston head 22 contacts the distal end of release member 54 and moves release member 54 proximally so that cams 72 no longer hold shoulders 68 engaged with buffer distal end 46 and additionally pivot latch members 66 so that shoulders 68 no longer contact buffer distal end 46, cylinder member 30 is then free to be telescopically received in buffer guide 44.

In operation, apparatus 10 functions in the following manner. When bolt group 12 is closed and the cartridge case is thus locked in the firing chamber of the barrel of the weapon, apparatus 10 is in the position as shown in the figure. After firing of the cartridge, bolt group 12 automatically moves backwards in an extraction movement to pull the empty casing from the barrel in preparation for a return movement of the bolt group 12 where a new cartridge is then positioned and locked in the firing position in the barrel. As noted, the extraction movement of bolt group 12 includes a rotation thereof which may interfere with proper engagement or holding of the extraction mechanism (not shown) with the cartridge rim and hence a failure to remove the empty cartridge. The initial extraction (and rotation) movement of bolt group 12 results in a force F and similar direction of movement as shown in the figure, which force and movement is exerted against piston stop 26 and hence ultimately against return drive spring 14 and the base.

As the initial (and hence fastest portion of) movement of bolt group 12 takes place, piston stop 26 is also initially moved, causing piston member 16 to be pushed further into cylinder member 30. This initial movement of piston member 16 is opposed by hydraulic fluid 38 in chamber 36, but as there is some small clearance or the like between piston head 22 and the surrounding reduced wall section 40 some hydraulic fluid 38 is permitted to pass by piston head 22 thus allowing a retarded or slowed movement of piston member 16 in response to the force/movement exerted by bolt group 12. This retarded movement only occurs for the short length of reduced wall section 40, since thereafter the clearance between piston head 22 and the remainder of the wall section of chamber 36 is large and there is no retarded flow of fluid past piston head 22. The initial retarded movement of piston head 22 thus similar slows or retards the initial movement of bolt group 12 for the same small distance which is when the centrifugal/initial force on the extractor mechanism of bolt group 12 is most likely to miss catching of the cartridge rim. Thus, it will be appreciated that after this initial retarded movement of bolt group 12, the extraction movement of bolt group 12 is not otherwise affected. With respect to the M4 carbine, the retarded movement is designed to approximately match the same speed of an M16 bolt group at this stage, where the similar rotating M16 bolt group does not have any similar extraction problem.

As bolt group 12 continues its backwards extraction (proximal) movement, piston head 22 eventually contacts stem 58 of release member 54 driving release member 54 proximally. As release member 54 moves proximally in cylinder proximal end 34, latch distal cams 72 of latch members 66 ride along camming surface 62 and down onto the reduced diameter portion of stem 58 so that shoulders 68 are no longer locked onto buffer distal end 46 of buffer guide 44. Further movement of release member 54 then causes release proximal end 76 of release member 54 to contact latch proximal cams 74 of each latch member 66 and to pivot each latch member 66 so that shoulders 68 are free from interference with buffer distal end 46 of buffer guide 44. With shoulders 68 thus free from interference, cylinder member 30 with piston member 16 then disposed therein is free (except for the designed counter force of drive spring 14) to be telescopically received in buffer guide 44 and to allow bolt group 12 to complete the extraction movement.

The return (opposite) loading movement of bolt group 12 after the extraction movement is complete takes place in the reverse order as described above and is driven by the force exerted by drive spring 14. It will be noted that the final short travel of bolt group 12 as bolt group 12 is locked in place in the barrel of the weapon, which corresponds to the portion where piston head meets and passes distally into reduced wall section 40 of cylinder member 30, results in a retarded driving force effected by drive spring 14 and hence a retarded end movement. This retarded end movement of bolt group 12 also has a benefit, and is thus desired. This benefit is that there is a tendency of bolt group 12 to bounce out of the locked position in the barrel, which is currently prevented by using a set of weights in the prior art buffer guide. Thus, with the apparatus of the present invention, such a set of weights is not required.

While apparatus 10 of the present invention does effect a slowed motion of bolt group 12, this slowed motion only occurs during the initial and final Â¼inch of movement and this slowed motion effects a much more reliable empty casing extraction. In addition, there is little effect on the overall time of travel of bolt group 12 since the retarded distance of travel is so small compared to the overall travel distance, so that the firing rate of the associated weapon is little effected.

Thus, while the present invention has been described with respect to an exemplary embodiment thereof, it will be understood by those of ordinary skill in the art that variations and modifications can be effected within the scope and spirit of the invention.

What is claimed is:

1. An apparatus for initially slowing a backwards extraction movement of a bolt group of a weapon firing a projectile, which bolt group moves backward automatically after firing of the projectile against a force of a return drive spring, said apparatus comprising:

a first longitudinal member having a first distal end and a first proximal end;

a second longitudinal member having a second distal end adjacent said first proximal end and a second proximal end;

a mounting means for mounting said first and second members for longitudinal movement of said first member relative to said second member and adjacent the drive spring with the drive spring urging said first and second members apart and against the bolt group; and a retarding means for retarding an initial backwards movement of said first proximal end relative to said second distal end and for allowing a relatively free further backwards movement of said first proximal end relative to said second distal end as the bolt group moves backwards after firing.

2. An apparatus as claimed in claim 1, wherein said retarding means includes a) a hydraulic chamber inside of said second member which is filled with a hydraulic fluid, b) a longitudinally short, inwardly reduced wall section of said chamber adjacent said second distal end, and c) a piston head at said first proximal end which is initially disposed at said reduced wall section and which is sized to pass therealong with a movement retarded by the passage of the hydraulic fluid thereabout, and which said piston head after passing said reduced wall section then easily passes along a remainder of said hydraulic chamber as the hydraulic fluid passes easily about said piston head and a remainder wall section of said chamber.

3. An apparatus as claimed in claim 1, wherein said mounting means includes a) a third longitudinal member having a third distal end and a third proximal end, with said mounting means also mounting said second and third members for longitudinal movement of said second member relative to said third member and adjacent the drive spring with the drive spring urging said second and third members apart and against the bolt group, and b) a latch means for releasably latching said second proximal end to said third distal end, said latch means including a release member which is contacted when said first proximal end approaches said second proximal end to release the latching of said second proximal end to said third distal end.

4. An apparatus as claimed in claim 3, wherein said retarding means includes a) a hydraulic chamber inside of said second member which is filled with a hydraulic fluid, b) a longitudinally short, inwardly reduced wall section of said chamber adjacent said second distal end, and c) a piston head at said first proximal end which is initially disposed at said reduced wall section and which is sized to pass therealong with a movement retarded by the passage of the hydraulic fluid thereabout, and which said piston head after passing said reduced wall section then easily passes along a remainder of said hydraulic chamber as the hydraulic fluid passes easily about said piston head and a remainder wall section of said chamber.

5. An apparatus as claimed in claim 4:

wherein said first longitudinal member is a piston member disposed inside of the drive spring and includes a) an elongate piston rod with said piston head provided at said first proximal end, and b) an enlarged piston stop provided at the first distal end against which a first end of the drive spring is engaged;

wherein said second longitudinal member is a cylinder member disposed inside of said drive spring and having said chamber disposed therein; and wherein said third longitudinal member is a buffer guide disposed inside of said drive spring and telescopically receiving said second proximal end of said cylinder member, said buffer guide including an enlarged buffer stop at the third proximal end against which a second end of the drive spring is engaged.

6. An apparatus as claimed in claim 5, wherein said release member is contacted by said piston head to release said second proximal end from said third distal end so that said second proximal end is then received in said buffer guide.

7. An apparatus as claimed in claim 6:

wherein said release member is spring biased towards said piston head and includes a camming surface; and wherein said latch means includes a pair of latch members having oppositely directed shoulders which engage said third distal end of said buffer guide and inwardly directed latch cams which slide along said camming surface.

8. An apparatus as claimed in claim 7:

wherein said latch members are each pivotally mounted to said second proximal end and include respective inwardly directed second latch cams; and wherein said release member includes a release proximal end which contacts said second latch cams as said release member is moved proximally such that said latch members are pivoted to move respective said shoulders from engagement with said third distal end.

9. An apparatus for initially slowing a backwards extraction movement of a bolt group of a weapon firing a projectile, which bolt group moves backward automatically after firing of the projectile against a force of a return drive spring, said apparatus comprising:

a piston member disposed inside of the drive spring including a) an elongate piston rod, b) an enlarged piston stop provided at a piston distal end of said piston rod against which a first end of the drive spring is engaged, and c) a piston head provided at a piston proximal end of said piston rod;

a cylinder member disposed inside of said drive spring and providing a chamber in which said piston head longitudinally moves, said cylinder member including a) a cylinder distal end in which said piston head is sealingly received, b) a cylinder proximal end, c) a longitudinally short, inwardly reduced wall section of said chamber disposed between said distal end and said proximal end at which said piston head is initially received prior to firing of the projectile, which said reduced wall section is sized to closely but slidingly receive said piston head therealong, d) a fluid located in said chamber, and e) a longitudinally long remainder wall section of said chamber disposed proximally of said reduced wall section which is sized to loosely receive said piston head therealong, such that when the projectile is fired initially a proximal movement of said piston head is retarded by passage of said fluid between said piston head and said reduced wall section but thereafter said piston head the proximal movement of said piston head is not retarded as the fluid passes easily between said piston head and said remainder wall section.

10. An apparatus as claimed in claim 9, further including:

a buffer guide disposed inside of said drive spring and telescopically receiving said cylinder proximal end, said buffer guide including a) a buffer distal end in which said cylinder proximal end is received, and b) a buffer proximal end including an enlarged buffer stop against which a second end of the drive spring is engaged; and a latch mechanism which releasably latches said cylinder proximal end to said buffer distal end, said latch mechanism including a release member which is contacted by said piston head to release said cylinder proximal end from said buffer distal end so that said cylinder proximal end is then received in said buffer guide.

11. An apparatus as claimed in claim 10:

wherein said release member is spring biased towards said piston head and includes a camming surface; and wherein said latch means includes a pair of latch members having oppositely directed shoulders which engage said buffer distal end of said buffer guide and commonly directed latch cams which slide along said camming surface.

12. An apparatus as claimed in claim 11:

wherein said latch members are each pivotally mounted to said cylinder proximal end and include respective inwardly directed second latch cams; and wherein said release member includes a release proximal end which contacts said second latch cams as said release member is moved proximally such that said latch members are pivoted to move respective said shoulders from engagement with said buffer distal end.

* * * * *

UNITED STATES PATENT AND TRADEMARK OFFICE

CERTIFICATE OF CORRECTION

PATENT NO. : 6,758,126 B1
DATED : July 6, 2004
INVENTOR(S) : Gary J. Houtsma

It is certified that error appears in the above-identified patent and that said Letters Patent is hereby corrected as shown below:

Title page,
Item [54], Title, delete "APPARATUS FOR INITIALLY SLOWLY A BACKWARDS MOVEMENT OF A BOLT GROUP" and substitute therefore -- APPARATUS FOR INITIALLY SLOWING A BACKWARDS MOVEMENT OF A BOLT GROUP OF A WEAPON --

Figure 2:
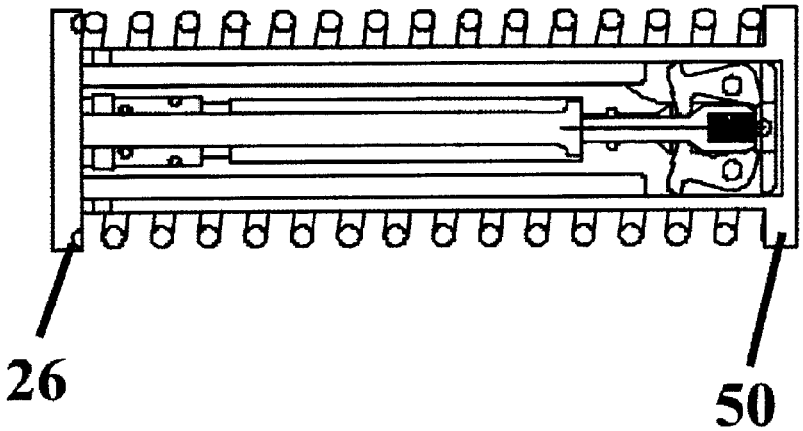

Column 3,
Line 19, delete "The single figure" and substitute therefore -- Figure 1 --
Line 22, add -- Figure 2 shows the apparatus in a compressed state. --
Line 26, delete "drawing" and substitute therefore -- drawings --.

Signed and Sealed this

Ninth Day of November, 2004

JON W. DUDAS
*Director of the United States Patent and Trademark Office*